US010928152B2

(12) United States Patent
Nuyts et al.

(10) Patent No.: US 10,928,152 B2
(45) Date of Patent: Feb. 23, 2021

(54) INTERFACE SUPPORT FOR AN AIMING SYSTEM

(71) Applicant: CMI Defence S.A., Loncin (BE)

(72) Inventors: Camille Nuyts, Liege (BE); Geoffroy Van Den Broucke, La Hulpe (BE); Philippe Delvaux, Beaufays (BE)

(73) Assignee: CMI DEFENCE S.A., Loncin (BE)

( * ) Notice: Subject to any disclaimer, the term of this patent is extended or adjusted under 35 U.S.C. 154(b) by 0 days.

(21) Appl. No.: 16/308,829

(22) PCT Filed: Jun. 9, 2017

(86) PCT No.: PCT/EP2017/064163
§ 371 (c)(1),
(2) Date: Dec. 11, 2018

(87) PCT Pub. No.: WO2017/216069
PCT Pub. Date: Dec. 21, 2017

(65) Prior Publication Data

US 2019/0310047 A1 Oct. 10, 2019

Related U.S. Application Data

(60) Provisional application No. 62/349,166, filed on Jun. 13, 2016.

(30) Foreign Application Priority Data

Oct. 21, 2016 (EP) ..... 16195001

(51) Int. Cl.
*F41G 11/00* (2006.01)
*F41G 1/393* (2006.01)
*F41A 23/24* (2006.01)

(52) U.S. Cl.
CPC ..... *F41A 23/24* (2013.01); *F41G 1/393* (2013.01); *F41G 11/004* (2013.01)

(58) Field of Classification Search
CPC ..... F41A 21/44; F41A 21/02; F41A 21/04; F41A 23/24; F41H 5/16; F41H 5/20;
(Continued)

(56) References Cited

U.S. PATENT DOCUMENTS 1,479,840 A * 1/1924 Stone ..... F41A 21/08 89/41.16
1,650,628 A * 11/1927 Inglis ..... F41G 1/3935 89/204

(Continued)

FOREIGN PATENT DOCUMENTS

CN 201440057 U 4/2010
CN 204064116 U 12/2014

(Continued)

*Primary Examiner* — Derrick R Morgan
(74) *Attorney, Agent, or Firm* — Leydig, Voit & Mayer, Ltd.

(57) ABSTRACT

A turret intended to be mounted on an armored vehicle includes: a barrel system having a barrel liner and a protective tube against impacts and vibrations connected to the barrel liner at a junction with a mask of the turret; and a rigid and interchangeable interface system to attach to the turret a piece of functional equipment including at least an aiming system. The interface system is fastened on the protective tube against the impacts and vibrations such that the interface system is placed in a plane perpendicular to a longitudinal axis of the barrel system. The interface system includes, in the following predefined order: an essentially semi-circular or semi-cylindrical enclosure serving as a support surrounding the protective tube against the impacts and vibrations; a base attached to the enclosure; a plate over the base; and a support fastened perpendicularly to the plate.

5 Claims, 2 Drawing Sheets

(58) Field of Classification Search
CPC ..... F41G 1/393; F41G 1/3935; F41G 11/001; F41G 11/004; F41G 1/40
USPC ..... 89/41.17, 36.13, 41.14
See application file for complete search history.

(56) References Cited

U.S. PATENT DOCUMENTS 2,094,015 A * 9/1937 Karnes ..... F41G 1/38 359/429
2,345,363 A * 3/1944 Smith ..... F41G 1/473 89/41.22
2,359,693 A * 10/1944 Tucker ..... F41G 1/393 89/203
2,775,817 A * 1/1957 Schuman ..... F41G 11/004 42/125
3,545,837 A * 12/1970 Chapman ..... F41G 1/3935 359/430
3,614,723 A * 10/1971 Hermes ..... F41G 3/22 367/120
4,026,054 A * 5/1977 Snyder ..... F41G 1/35 42/115
4,214,372 A * 7/1980 Rusbach ..... F41G 1/46 42/138
4,358,984 A * 11/1982 Winblad ..... F41H 5/16 89/36.06
4,524,675 A * 6/1985 Durenec ..... F41G 11/002 42/131
4,570,530 A * 2/1986 Armstrong ..... F41G 3/22 348/143
4,753,154 A * 6/1988 Higashi ..... F41A 21/44 165/104.26
4,762,048 A * 8/1988 Higashi ..... F41A 13/12 165/47
4,934,085 A * 6/1990 Lough ..... F41G 11/003 42/124
5,036,748 A * 8/1991 Pendry ..... F41A 23/24 89/36.13
5,062,346 A * 11/1991 Greve Hansen ..... F41A 21/44 89/14.1
5,101,590 A * 4/1992 Hawkins ..... F41G 11/001 42/111
5,392,687 A * 2/1995 Shiells ..... F41H 5/16 89/36.08
5,400,691 A * 3/1995 Suttie ..... F41A 21/44 89/14.1
5,490,654 A * 2/1996 Herriman ..... F41G 11/001 248/309.1
5,659,965 A * 8/1997 Thibodeau ..... F41G 1/16 42/126
6,237,463 B1 * 5/2001 Grizzaffi ..... F41A 35/00 89/37.01
6,260,466 B1 * 7/2001 Humphreys ..... F41G 3/08 89/41.03
6,568,118 B1 * 5/2003 Teetzel ..... F41G 1/36 42/105
6,729,223 B2 * 5/2004 De Lapasse ..... F41H 5/26 42/111
6,832,604 B1 * 12/2004 Thompson ..... F41B 11/57 124/75
7,597,041 B2 10/2009 Gerstadt et al.
7,934,652 B2 * 5/2011 Hasselbring ..... G01C 19/38 235/404
8,011,130 B2 * 9/2011 Chang ..... F41G 11/002 42/124
8,578,644 B1 * 11/2013 Oquin ..... F41G 11/003 42/124
8,590,441 B1 * 11/2013 Good ..... F41G 11/001 42/146
9,207,044 B2 * 12/2015 Brown ..... F41F 1/06
2002/0045999 A1 * 4/2002 Bollweg ..... F41G 3/2683 702/158
2003/0010185 A1 * 1/2003 O'Dwyer ..... G01V 1/104 89/1.41
2005/0223613 A1 * 10/2005 Bender ..... F41A 3/36 42/16
2006/0144216 A1 * 7/2006 Shipman ..... F41F 1/06 89/37.05
2006/0288626 A1 * 12/2006 Kim ..... F41G 11/003 42/73
2008/0107414 A1 * 5/2008 Showalter ..... G03B 17/561 396/429
2010/0011952 A1 * 1/2010 Anderson ..... F41G 1/393 89/44.02
2010/0154280 A1 * 6/2010 LaFrance ..... F41H 5/12 42/124
2010/0269681 A1 * 10/2010 Shipman ..... F41G 11/004 89/42.01
2012/0117847 A1 * 5/2012 Evans-Hendrick ..... F41G 11/003 42/90
2012/0160089 A1 * 6/2012 Burzel ..... F41G 3/323 89/41.17
2015/0198418 A1 * 7/2015 Woida-O'Brien ... G03H 1/0005 42/134
2015/0233676 A1 * 8/2015 Brown ..... F41G 3/16 89/37.05
2016/0003570 A1 * 1/2016 Tonkin ..... F41A 21/04 89/14.4
2016/0209174 A1 * 7/2016 Hartley ..... F41G 1/22
2016/0363402 A1 * 12/2016 Mogle ..... F41A 21/02
2017/0261280 A1 * 9/2017 Glisovic ..... F41A 21/24
2018/0283826 A1 * 10/2018 Alldredge ..... F41A 3/66
2018/0364009 A1 * 12/2018 Hancosky ..... F41G 1/35
2019/0003803 A1 * 1/2019 Kapogianis ..... F41G 3/12
2019/0234710 A1 * 8/2019 Batenhorst ..... F41G 11/004
2020/0088497 A1 * 3/2020 Hartman ..... F41G 1/50

FOREIGN PATENT DOCUMENTS

EP 0082257 A 6/1983
EP 0425386 A1 5/1991
EP 1715283 A1 10/2006
FR 1596510 A 6/1970
FR 2459447 A1 1/1981
RU 5733 U1 1/1998
RU 2321815 C1 1/2008
UA 12815 U 3/2006

* cited by examiner

INTERFACE SUPPORT FOR AN AIMING SYSTEM

CROSS-REFERENCE TO PRIOR APPLICATIONS

This application is a U.S. National Phase application under 35 U.S.C. § 371 of International Application No. PCT/EP2017/064163, filed on Jun. 9, 2017, and claims benefit to European Patent Application No. EP 16195001.9, filed on Oct. 21, 2016, and U.S. Provisional Patent Application No. 62/349,166, filed on Jun. 13, 2016. The International Application was published in French on Dec. 21, 2017 as WO 2017/216069 under PCT Article 21(2).

FIELD

The technological field of the invention relates to the integration of an interface support on a barrel system with different calibers such that:

said interface support is dedicated to receiving a non-specific aiming system, said barrel system covers the range of medium and large calibers, in other words between 20 mm and 120 mm, said barrel system is associated with a turret mounted on any armored vehicle.

The invention is essentially based on a mechanical approach.

BACKGROUND

In general, the insertion of an (or a combination of) aiming system(s) on a turret must consider an entire series of parameters, both functional and mechanical.

These include:

the exterior bulk of the turret related to the integration of the other modules, such as missile launchers, grenade launchers, communication system (antenna(s), radio(s), etc.), weather station, etc., the fastening system, sensitivity, precision, vibrations, impacts, etc.

Based on these specific criteria, the possibility of adding an additional aiming system with respect to those already present on the turret is relatively limited. This is related to the fact that the position of the latter must not in any case functionally and/or mechanically disrupt the modules previously attached.

That is why it is essential to leverage a location not yet used to meet the new contractual constraints, but also to economically optimize the turret previously developed.

Currently, the main proposed and/or considered solutions are based on the fact that the optical system is placed essentially on the mask of the turret, where i) the fastening mode does not perform as well, and ii) the perceived impacts and vibrations are characterized by an increased intensity. Added to this is the fact that the bulk at the mask following the presence of other modules such as coaxial machine gun, ammunition ejection system, etc. is such that it is not always easy to add an additional element.

The following documents have been identified in the state of the art:

Document EP 1,715,283 primarily relates to mounting small- or medium-caliber weapons on a turret associated with the naval field, these weapons being equipped with an optoelectronic sight unit placed at the weapons/turret interface.

Document FR 2,459,447 relates to an armored turret including a main weapon equipped with an own vision system with a field of less than 360° and of weapon pointing, said own system having a laser telemeter and means of light intensifying night vision.

Document RU2006125262 relates to a turret, having a main weapon, at which an optical system is fastened on the mask with basic securing means.

Document U.S. Pat. No. 4,934,085 discloses an adapter support for mounting a generally cylindrical night sight on a missile launcher without structural modification of the two associated devices.

Document EP 0,082,257 discloses a support making it possible to attach an accessory quickly, in particular an optical device, on the barrel of a firearm, this support being placed parallel to the longitudinal axis of said barrel. The support is fastened on a ring, surrounding the tube and able to be tightened by tightening screws. These tightening screws are for example hexagonal socket screws.

Document U.S. Pat. No. 7,597,041 relates to a pivoting barrel mounted on a moving structure/base. The barrel is characterized in that it contains a gyroscope, which will be an essential element for recording data relative to the stabilization of the barrel.

Document RU5733 relates to a turret having different optical systems, one of which is placed at the mask and in the same alignment as that defined by the axis of the barrel.

Document EP 0,425,386 discloses a fire control system adaptable for use on a mask sighting telescope of a turret in particular including a stabilized mirror, a telemetry laser and an electronic control box. The fire control system is characterized in that it comprises a box welded on the mask of the turret.

Other documents, such as CN204064116, CN201440057, are of some interest, but are less significant than those previously described.

This approach can be likened to that developed in portable firearms where the analyzed device is equivalent to the telescope sight, but the structural features of which do not meet the same requirements.

SUMMARY

In an embodiment, the present invention provides a turret intended to be mounted on an armored vehicle, comprising: a barrel system having a barrel liner and a protective tube against impacts and vibrations connected to the barrel liner at a junction with a mask of the turret; and a rigid and interchangeable interface system configured to attach to the turret a piece of functional equipment comprising at least an aiming system, the interface system being fastened on the protective tube against the impacts and vibrations such that the interface system is placed in a plane perpendicular to a longitudinal axis of the barrel system, the interface system comprising, in the following predefined order: an essentially semi-circular or semi-cylindrical enclosure serving as a support surrounding the protective tube against the impacts and vibrations; a base attached to the enclosure; a plate over the base; and a support fastened perpendicularly to the plate.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
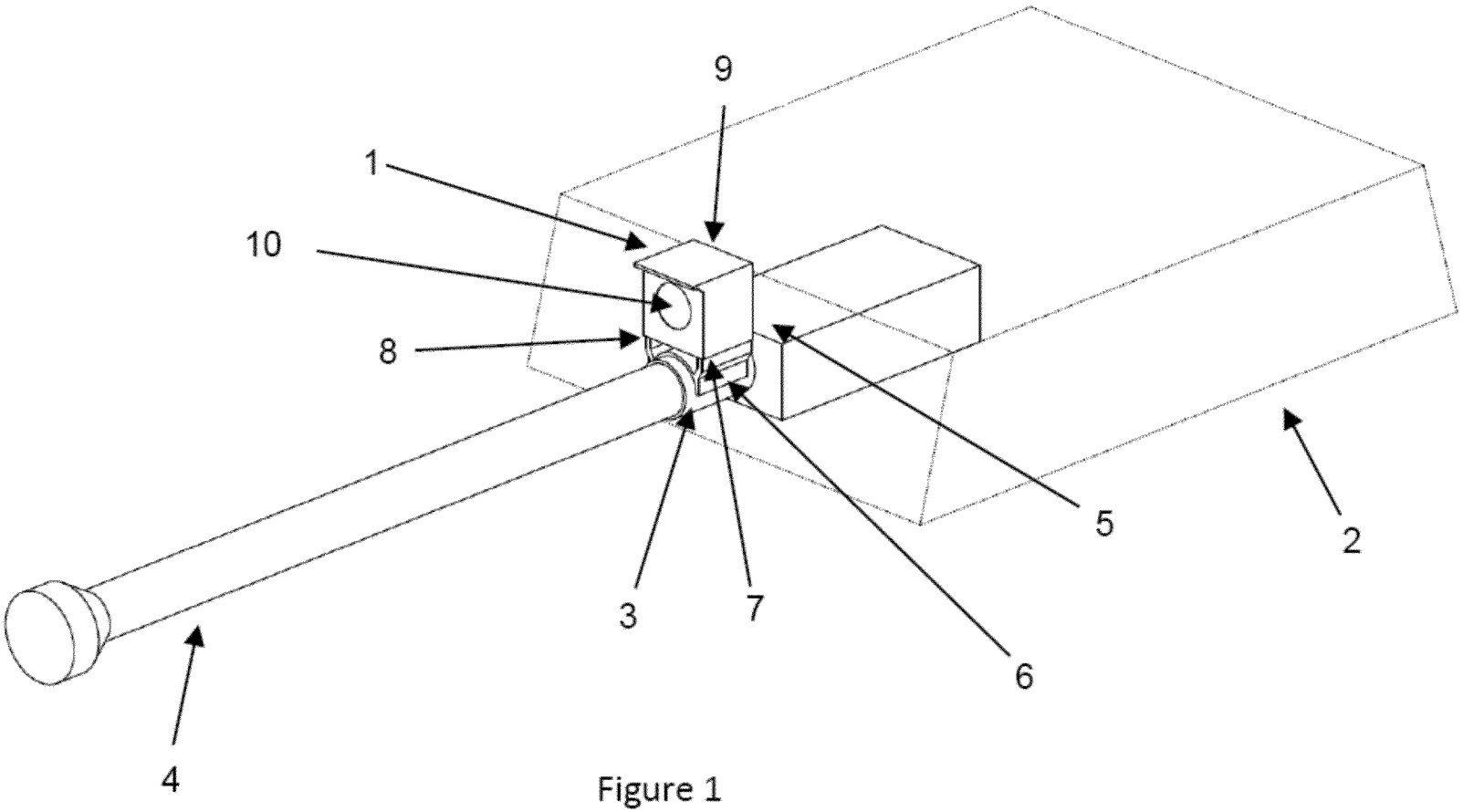
FIG. 1 shows a perspective view of an example interface support according to the present invention.

In an embodiment, the present invention provides an architecture inspired by portable firearms, in which a telescope sight is integrated directly on the barrel of the weapon.

In an embodiment, the present invention provides a rigid and interchangeable structure, called interface support, characterized in that it:

- has a fastening method using screws (mechanical approach),
- contains a non-specific aiming module.

In an embodiment, the present invention does not limit the size of the interface support with precise dimensions, but the width, length and height thereof must respectively be characterized by minimum and maximum values, demonstrating a certain flexibility, which must nevertheless remain consistent with mechanical and functional constraints. Through these geometric characteristics, the size of the aiming system proportionally has a similar flexibility, i.e., it is not specific and not standard for a single interface support.

In an embodiment, the present invention enables the use of an existing turret without making essential structural and functional changes thereto while guaranteeing a relatively insignificant or moderate financial investment in light of the technical benefits created by the placement of the device according to the invention.

One embodiment of the invention discloses a turret intended to be mounted on an armored vehicle, comprising a barrel system having a barrel liner and a protective tube against the impacts and vibrations, connected to the liner of the barrel at the junction with the mask of the turret, and comprising an interface system, also called interface support, rigid and interchangeable to attach to the turret a piece of functional equipment comprising at least an aiming system, the interface system being fastened on the protective tube against the impacts and vibrations, such that the interface system is placed in a plane perpendicular to the longitudinal axis of the barrel system.

According to the invention, the interface system comprises, in the following predefined order:

- an essentially semi-circular or semi-cylindrical enclosure serving as a support surrounding said protective tube against the impacts and vibrations,
- a base attached to said enclosure,
- a plate topping said base, and
- a support fastened perpendicular to said plate.

The vicinity of the junction between the protective tube connected to the liner of the barrel system and the mask of the turret, these elements being well known by those skilled in the art, is the location where the impacts and vibrations experienced by the barrel system have the lowest intensity during any movement of the barrel system, this movement being a vertical or horizontal movement, or both at the same time. All of the movements are made in four specific scenarios: i) vehicle and turret static, ii) vehicle stopped and turret rotating, iii) vehicle moving turret stationary, and iv) vehicle and turret moving.

Due to the position of the interface support, and in fine the optical system, on the protective tube of the barrel system, the associated aiming system is also situated in the vertical plane (or perpendicular to the longitudinal axis of the barrel system).

Advantageously, the optical axis of the aiming system will be parallel or slightly inclined relative to the longitudinal axis of the barrel system so that the target remains in the field of view of the aiming system, which makes it possible to no longer need to have a mechanical and/or electronic link between the barrel system and the aiming system.

The interfacing between the interface support and the aiming system is advantageously done from the rear of the aiming system to optimize the securing between the two devices.

Also preferably, the set of elements made up of the protective tube, the essentially semi-circular or semi-cylindrical enclosure, the base, the plate and the support are fastened to one another in the above predefined order, also preferably by a screw and/or bolt (or screw/nut) system. The aiming system is also advantageously fastened to the support of the interface system by a screw and/or bolt system.

The project currently being developed makes it possible to achieve significant operational, functional, ergonomic, economic, etc. levels after the positioning defined above.

In terms of the mechanical aspects, the mounting approach is relatively easy, while allowing a rigid fastening configuration to be able to absorb all of the impacts and vibrations as needed during the various movements experienced by the barrel system as previously described.

Furthermore, to favor such mounting, it is advantageous for the turret, and more particularly the environment at the interface around the barrel system, to undergo only slight structural modifications. The latter can appear essentially at the thickening of the protective tube of the barrel system. That is why the device according to the invention can advantageously be mounted on all of the protective tubes connected to the liner of medium- and large-caliber barrel systems.

Figure 2:
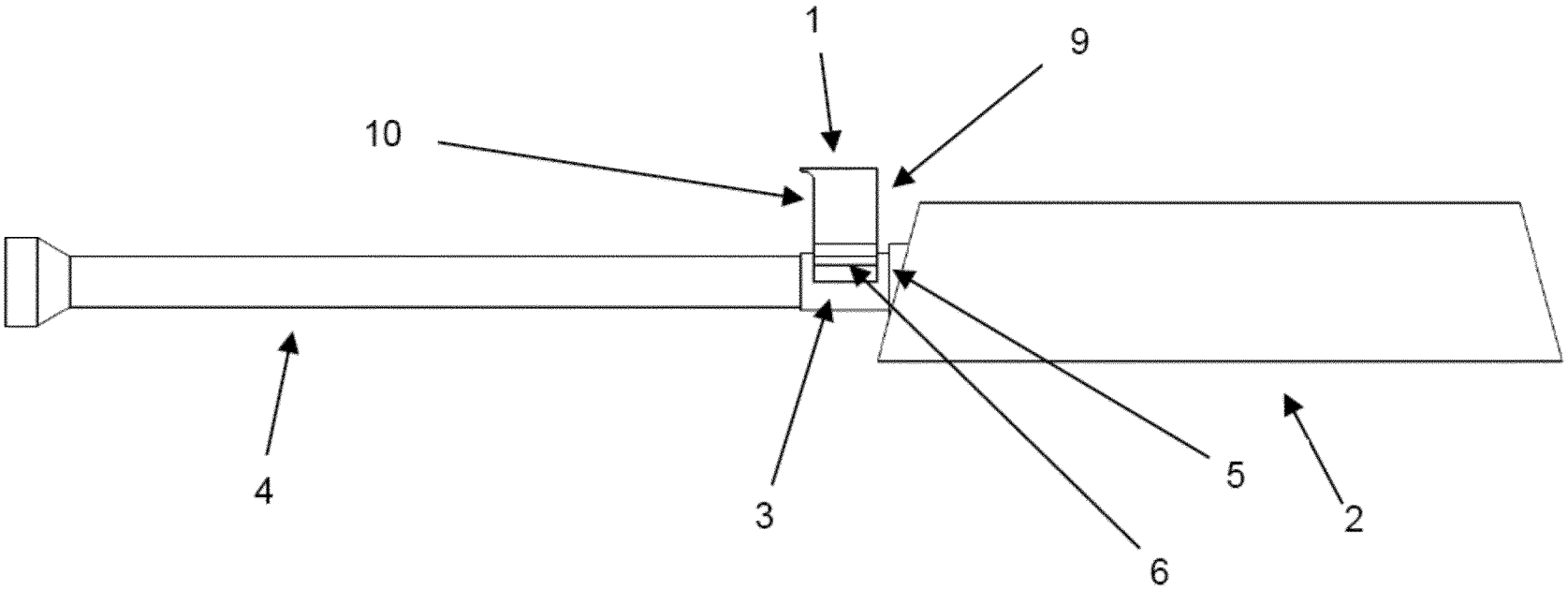
FIG. 2 shows an elevation view of an example interface support according to the present invention.

As shown in FIGS. 1 and 2, the base element of the invention is the interface support 1.

First from a structural perspective, this is a rigid and interchangeable element positioned at a turret 2, mounted on any armored vehicle, and more particularly on the protective tube 3 connected to the liner of the barrel system 4 at the junction with the mask 5 of said turret 2.

This interface support 1 is formed by an essentially semi-circular or semi-cylindrical enclosure 6 defined as a support surrounding the protective tube 3 of the barrel system 4. This essentially semi-circular or semi-cylindrical enclosure 6 is topped by a base 7, above which a plate 8 appears.

Perpendicular to the plate 8 is a support 9 at which the aiming system 10 will be attached. The aiming system 10 is fastened in any location of said support 9; in other words, the height at which the two aforementioned devices are attached has no impact on the structural aspect of the interface support 1.

The set of elements described above, i.e., the protective tube 3, the semi-circular or semi-cylindrical enclosure 6, the base 7, the plate 8, the support 9 and the aiming system 10, are respectively fastened to one another for example using a screw (or bolt) system according to the assembly previously defined.

The dimensions of the different component elements of the interface support 1 can vary based on the nature of the inserted aiming system 10, but must respectively be comprised within a certain range defined by minimum and maximum values so as to favorably respond to the structural and functional aspects of the interface support 1. Mechanically, the attaching method must not in any case be modified following any variation of the dimensions of said interface support 1.

The desired structural aim is based on the fact that the location of said interface support 1 is characterized by a rigid zone appropriate for a specific fastening mode (see above), this zone being influenced by the bulk defined by the surrounding modules (other aiming systems, coaxial machine gun, etc.).

From a functional perspective, the interface support 1 described above has the feature of being inserted in a location where the impacts and vibrations experienced by said interface support 1 are of lower intensity relative to those experienced in other environments of the turret 2 or the barrel system 4.

The fastening mode according to the present invention:

is mechanically easy and inexpensive, causes only slight structural modifications essentially located at the thickening of the protective tube 3 of the barrel system 4.

The interface support 1 is fastened on a turret mounted on any armored vehicle, on which a barrel 4 is associated with different calibers covering the range of medium and large calibers, i.e., between 20 mm and 120 mm.

This fastening approach, confirmed by digital simulation, is the result of several investigations conducted in several locations of the turret 2 or the barrel system 4. These include the following tests conducted for positioning of the interface support 1:

on the mask 5 with the interface support 1 located in the horizontal plane of the barrel system 4, on the barrel system 4 itself with the interface support 1 placed in the horizontal plane of the barrel system 4.

For the tests of different possible locations, a set of movements of the barrel system 4 was taken into account, respectively characterized by a vertical or horizontal movement, or both at the same time. The four possibilities related to these movements are as follows:

static vehicle and turret, vehicle stopped and turret rotating, vehicle moving and turret stationary, moving vehicle and turret.

Ultimately, at the height of the interface support 1, a non-specific aiming system 10 is attached, this aiming system 10 being considered a primary and/or secondary device with respect to the other aiming systems attached on the turret 2. The functional specificity will be defined in fine by the contractual constraints.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1 interface system
2 turret
3 protective tube
4 (liner of the) barrel system
5 mask
6 essentially semi-circular or semi-cylindrical enclosure
7 base
8 plate
9 support
10 aiming system

The invention claimed is:

1. A turret for mounting on an armored vehicle, comprising:

a mask or gun mantlet;

a barrel system covering calibers higher than 20 mm, the barrel system comprising a barrel liner and a protective tube configured to dampen impacts and vibrations, the protective tube being connected to the barrel liner at a junction between the barrel liner and the mask or gun mantlet of the turret; and a rigid and interchangeable interface system configured to attach a piece of functional equipment to the turret, the interface system comprising at least an aiming system, the aiming system having an optical axis parallel or slightly inclined relative to a longitudinal axis of the barrel system so that a target can be kept in a field of view of the aiming system, the interface system being fastened on the protective tube so that the interface system is placed distantly from the mask or gun mantlet and in a plane perpendicular to the longitudinal axis of the barrel system, the interface system consisting of, in order, the following distinct components:

an essentially semi-circular or semi-cylindrical enclosure serving as a support surrounding the protective tube, the enclosure being attached to the protective tube;

a base attached to the enclosure;

a plate attached to the base; and a support fastened perpendicularly to the plate, wherein the enclosure, base, plate, and support are respectively fastened in order with one another using screws or bolts so as to constitute the interface system.

2. The turret according to claim 1, wherein the aiming system is situated in a plane perpendicular to the longitudinal axis of the barrel system.

3. The turret according to claim 1, wherein the support is disposed in a location where impacts and vibrations experienced by the interface system are of a lowest intensity in the turret or the barrel system.

4. The turret according to claim 1, wherein dimensions of the protective tube and of the components of the interface system are variable based on a nature of the aiming system.

5. The turret according to claim 1, wherein the barrel system of the turret is configured for movement either vertically or horizontally, or both at the same time, the movement taking place in four configurations, respectively: a first configuration with static vehicle and turret, a second configuration with vehicle stopped and turret rotating, a third configuration with vehicle moving and turret stationary, and a fourth configuration with vehicle and turret both moving.

* * * * *